US005294120A

United States Patent [19]

Schultz

[11] Patent Number: 5,294,120

[45] Date of Patent: Mar. 15, 1994

[54] VIDEO POKER

[75] Inventor: Phillip C. Schultz, West Bloomfield, Mich.

[73] Assignee: MP Software, W. Bloomfield, Mich.

[21] Appl. No.: 879,930

[22] Filed: May 8, 1992

[51] Int. Cl.[5] ..... A63F 9/00; A63F 1/00

[52] U.S. Cl. ..... 273/85 CP; 273/138 A

[58] Field of Search ..... 273/85 CP, 85 G, 138 R, 273/138 A, 143 R, 292; 364/412

[56] References Cited

U.S. PATENT DOCUMENTS

| | | | |
|---|---|---|---|
| 3,889,956 | 6/1975 | Castle | 273/138 |
| 4,648,604 | 3/1987 | Horan | 273/292 |
| 4,743,022 | 5/1988 | Wood | 273/85 CP |
| 4,760,527 | 7/1988 | Sidley | 364/412 |
| 4,836,553 | 6/1989 | Suttle et al. | 273/292 |
| 4,926,327 | 5/1990 | Sidley | 364/412 |
| 5,013,049 | 5/1991 | Tomaszewski | 273/292 |
| 5,019,973 | 5/1991 | Wilcox et al. | 364/412 |
| 5,022,653 | 6/1991 | Suttle et al. | 273/85 CP |
| 5,033,744 | 7/1991 | Bridgeman et al. | 273/85 CP |
| 5,042,818 | 8/1991 | Wiengardt | 273/292 |
| 5,046,735 | 9/1991 | Hamano et al. | 273/85 CP |

OTHER PUBLICATIONS

Copyright Registration TX 2,182,560 dated Oct. 19, 1987 for Dollar Video Poker.

Copyright Registration TXu 459,781 dated Apr. 1, 1991 for Player's Choice Video Poker.

Copyright Registration TXu 300,808 dated Oct. 19, 1987 for Player's Choice Video Poker.

*Primary Examiner*—Jessica J. Harrison

*Attorney, Agent, or Firm*—Brooks & Kushman

[57] ABSTRACT

An improved video poker variation in which the player must make an initial commitment as to the number of draw cards. The player then uses draw cards to replace unwanted cards one at a time. Payoff tables are varied depending on the number of draw cards selected. The game also provides the player with an option to end the game prior to drawing the committee number of cards with a reduced final payoff.

10 Claims, 15 Drawing Sheets

PLAYER'S CONSOLE and PLAY

PLAYER'S CONSOLE and PLAY

PLAYER'S CONSOLE and PLAY

NOTE: STEP THREE Is Repeated Until No More Cards Are Left To Draw, Or The END Feature Is Used By The Player.

VIDEO POKER

FIELD OF INVENTION

This invention relates to a method for playing a casino game as a computer video game, and more particularly to a modified video poker game.

PRIOR ART

The basic game of video poker has been in casinos for approximately ten years and several variations of this very popular game have appeared. In the basic game, the player is allowed to inspect five cards randomly chosen by the computer. These cards are displayed on the video screen and the player chooses which cards, if any, that he or she wishes to hold. If the player wishes to hold all of the cards, i.e. stand, he or she presses a STAND button. If the player wishes to hold only some of the cards, he or she chooses the cards to be held by pressing HOLD keys located directly under each card displayed on the video screen. Pushing a DEAL button after choosing the HOLD cards automatically and simultaneously replaces the unchosen cards with additional cards which are randomly selected from the remainder of the deck. After the STAND button is pushed, or the cards are replaced, the final holding is evaluated by the game machine's computer and the player is awarded either play credits or a coin payout as determined from a payoff table. This payoff table is stored in the machine's computer memory and is also displayed on the machine's screen. Hands with higher poker values are awarded more credits or coins. Very rare poker hands are awarded payoffs of 800-to-1 or higher.

Video poker games have become immensely popular because they combine the card strategy of games like blackjack with potentially large jackpot payoffs typical of reel-type slot machines.

In addition to the basic video poker game described above, several other variations of video poker exist. Currently, the most popular variations include wild cards, which provide an extra degree of volatility to the basic game and consequently appeal to a specific group of video poker enthusiasts. The wild cards are typically deuces, a joker or a combination thereof.

Another variation pays the player for either high- or low-valued poker hands. Upon inspecting the original five cards, the player must choose whether to try for a high-valued hand or a low-valued hand when drawing additional cards. This variation is not as popular as the wild card variation and has never met with much commercial success.

Another variation known as 2nd Chance Poker is disclosed in U.S. Pat. No. 4,743,022. This game is played in the same manner as the basic video poker game except that, with an additional bet, a sixth card may be drawn to improve the hand. The payoff table is changed in the computer when the sixth card is drawn to reflect the changed odds.

Another prior art game is disclosed in U.S. Pat. No. 5,033,744 to Bridgeman, et al. This reference describes a variation of video poker in which cards not designated as HOLD cards are replaced one card at a time. This variation enables the player to inspect the five card holding after each card is replaced individually rather than after all of the cards have been replaced. Additionally, a constant payoff table is provided. This means that a winning hand is awarded the same payoff regardless of the number of cards drawn to achieve it. The '744 reference describes the use of guiding symbols to advise the player as to which cards to replace to improve the value of the poker hand. This variation also contains a provision for an instant game ending for winning hands which are at or exceed a predetermined winning hand level designed into the machine. When such a hand is recognized by the machine's computer, the game immediately ends independent of any action by the player.

All of the characteristics which are described in the '744 reference produce a game which is extremely advantageous for the player. Consequently, the game's profitability would be unacceptably low for casino owners unless the constant payoff table was reduced to offset this problem. Reducing payoffs, however, would make the '744 video poker game unacceptable to players because of its inability to match payoffs for similar winning hands achieved on the basic game.

Present variations of video poker do not provide the player with an initial player commitment to the number of draw cards, nor do they provide payoff tables which vary depending on the number of draw cards selected. Additionally, there are no provisions for an early END-GAME-with-reduced-payoffs feature. Also, a game with these features should embody the same degree of profitability to casino owners, or "expected player return" to players, as the current basic game. A video poker game with these features would not only appeal to players who seek an additional degree of card strategy and player involvement, but would also appeal to casino owners.

SUMMARY OF INVENTION

Therefore, it is an object of this invention to provide a unique variation of video poker which is offers a high level of player involvement and is easy to learn.

Another object of this invention is to provide a video poker variation which provides winning hand payoffs similar to the basic video poker game.

Yet another object of this invention is to provide a video poker game variation which assures a level of profitability for casinos which is equivalent to the currently produced basic video poker game.

These and other objects and advantages of this invention shall become apparent from the following descriptions of the invention.

Accordingly, a casino type video poker game is described wherein a player places his or her bet inro the machine and pushes a button labelled DEAL. The first five cards are displayed on the video screen and the player is allowed to inspect these cards and designate the number of cards he or she wishes to draw. At this point, the player only commits to the number of draw cards and not the actual cards to be replaced. The player then designates the number of cards by entering a draw value into the machine. The player accomplished this by pressing the button on the console which corresponds with the number of cards he or she wishes to draw. Before proceeding further, the player can change his or her mind and select a different number of draw cards by pushing another button on the console labelled "CANCEL". If the player does not wish to draw any cards, a button labelled "STAND" is pressed. The player then proceeds to replace the designated number of draw cards one card at a time. Replacement of a draw card is accomplished by pressing a button labelled "DRAW". One DRAW button is positioned under each card under the video screen. The computer then replaces the selected draw card with a card randomly chosen from the remaining cards in the deck and prints a "DRAWN" message on the screen under the new card. Once a card has been replaced with a new card, the new card in that position on the video screen cannot be replaced again and the "DRAWN" message under the card is an indication to the player of this limitation. A draw counter which is displayed on the video screen shows the remaining number of draw cards available to the player and is decremented each time a new card is drawn.

If the player receives a winning hand by drawing fewer cards than he or she originally anticipated, he or she can end the game by pressing a button labelled "END GAME". Otherwise, the player can replace all of the committed number of draw cards. When all of the draw cards are used, the game is over. It this point, the machine's computer evaluates the final hand displayed and pays off accordingly. The payoff for winning hands either in play credits or coins, is based on a payoff table which is stored in the computer's emory and also displayed to the player during play.

Variable payoff tables are used to determine the payoff per unit bet. The more cards that are drawn to achieve a winning hand, the lower the long-term, overall payoff. If the END GAME feature is used, the player is paid at a rate equal to one-half of the rate for a winning hand if all of the committed cards had been drawn.

DETAILED DESCRIPTION OF THE PREFERRED EMBODIMENT

Figure 1:
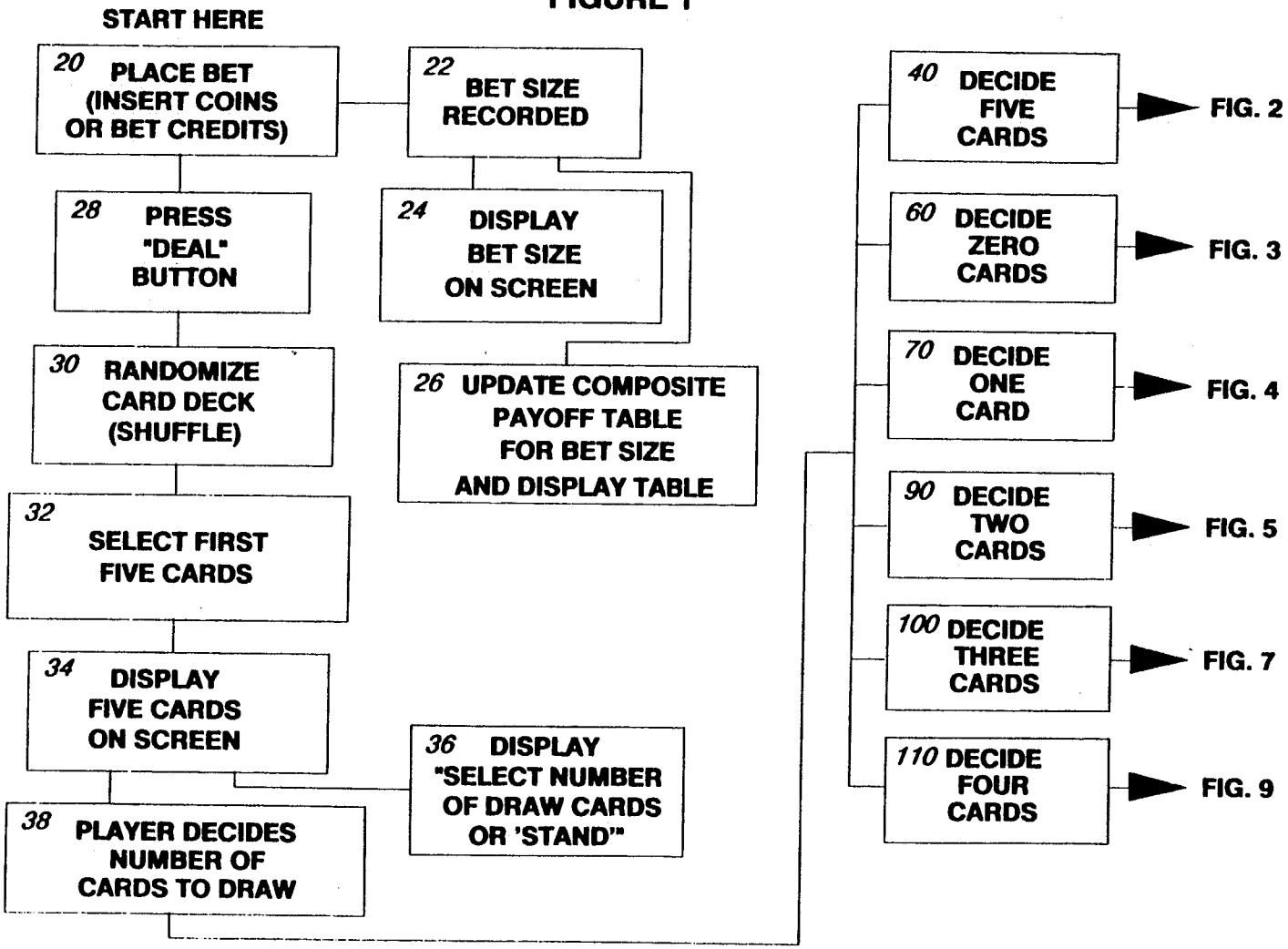
FIG. 1 is a block diagram illustrating the game's initial steps at the beginning of play.

Referring to FIG. 1, a player begins the game by placing a bet 20. This is accomplished by inserting coins or bet credits into the video poker machine. The computer then records the bet size 22 in its memory, displays the bet size on the screen 24 and displays one of the following composite payoff tables 26, depending on the bet size:

| | COMPOSITE PAYOFF TABLE | | |
|---|---|---|---|
| | DRAW ANY ONE, TWO FIVE CARDS OR "STAND" | DRAW ANY THREE CARDS | DRAW ANY FOUR CARDS |
| | Payoffs For 5 Coins Bet | | |
| ROYAL FLUSH | 4000 | 4000 | 4000 |
| STRAIGHT FLUSH | 250 | 250 | 250 |
| FOUR OF A KIND | 125 | 100 | 100 |
| FULL HOUSE | 40 | 30 | 30 |
| FLUSH | 30 | 20 | 20 |
| STRAIGHT | 20 | 20 | 20 |
| THREE OF A KIND | 15 | 10 | 10 |
| TWO PAIR | 10 | 10 | 5 |
| HIGH PAIR (JACKS OR BETTER) | 5 | 5 | 5 |
| | Payoffs For 4 Coins Bet | | |
| ROYAL FLUSH | 1000 | 1000 | 1000 |
| STRAIGHT FLUSH | 200 | 200 | 200 |
| FOUR OF A KIND | 100 | 80 | 80 |
| FULL HOUSE | 32 | 24 | 24 |
| FLUSH | 24 | 16 | 16 |
| STRAIGHT | 16 | 16 | 16 |
| THREE OF A KIND | 12 | 8 | 8 |
| TWO PAIR | 8 | 8 | 4 |
| HIGH PAIR (JACKS OR BETTER) | 4 | 4 | 4 |
| | Payoffs For 3 Coins Bet | | |
| ROYAL FLUSH | 750 | 750 | 750 |
| STRAIGHT FLUSH | 150 | 150 | 150 |
| FOUR OF A KIND | 75 | 60 | 60 |
| FULL HOUSE | 24 | 18 | 18 |
| FLUSH | 18 | 12 | 12 |
| STRAIGHT | 12 | 12 | 12 |
| THREE OF A KIND | 9 | 6 | 6 |
| TWO PAIR | 6 | 6 | 3 |
| HIGH PAIR (JACKS OR BETTER) | 3 | 3 | 3 |
| | Payoffs For 2 Coins Bet | | |
| ROYAL FLUSH | 500 | 500 | 500 |
| STRAIGHT FLUSH | 100 | 100 | 100 |

-continued

| COMPOSITE PAYOFF TABLE | DRAW ANY ONE, TWO FIVE CARDS OR "STAND" | DRAW ANY THREE CARDS | DRAW ANY FOUR CARDS |
|---|---|---|---|
| FOUR OF A KIND | 50 | 40 | 40 |
| FULL HOUSE | 16 | 12 | 12 |
| FLUSH | 12 | 12 | 12 |
| STRAIGHT | 8 | 8 | 8 |
| THREE OF A KIND | 6 | 6 | 6 |
| TWO PAIR | 4 | 4 | 2 |
| HIGH PAIR (JACKS OR BETTER) | 2 | 2 | 2 |
| Payoffs For 1 Coin Bet | | | |
| ROYAL FLUSH | 250 | 250 | 250 |
| STRAIGHT FLUSH | 50 | 50 | 50 |
| FOUR OF A KIND | 25 | 20 | 20 |
| FULL HOUSE | 8 | 6 | 6 |
| FLUSH | 6 | 4 | 4 |
| STRAIGHT | 4 | 4 | 4 |
| THREE OF A KIND | 3 | 2 | 2 |
| TWO PAIR | 2 | 2 | 1 |
| HIGH PAIR (JACKS OR BETTER) | 1 | 1 | 1 |

As shown on the tables, the payoff increases as more coins or credits are bet by the player. A message indicating that payoffs are reduced by half if the game is ended early may also be displayed on the screen.

After the computer records the bet size 22, the player presses a "DEAL" button 28. The computer then randomizes the card deck 30 and selects five cards from the "shuffled" deck 32. The five cards chosen by the computer 32 are then displayed on the screen 34 along with a message instructing the player to either select a number of draw cards or STAND 36. At this point, the player decides the number of cards he or she wishes to draw 38. This initial decision commits the player to a specific number of draw cards, and also enables the computer to choose an appropriate payoff table and display it on the screen. The computer displays one of the following tables throughout game play:

PAYOFF TABLE 1

For Selections of ONE, TWO or FIVE DRAW CARDS, or "STAND"

| | Number of Coins Bet | | | | |
|---|---|---|---|---|---|
| | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 8 | 16 | 24 | 32 | 40 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| HIGH PAIR (JACKS OR BETTER) | 1 | 2 | 3 | 4 | 5 |

PAYOFF TABLE 2

For Selection of THREE DRAW CARDS

| | Number of Coins Bet | | | | |
|---|---|---|---|---|---|
| | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR OF A KIND | 20 | 40 | 60 | 80 | 100 |
| FULL HOUSE | 6 | 12 | 18 | 24 | 30 |
| FLUSH | 4 | 8 | 12 | 16 | 20 |
| STRAIGHT | 4 | 8 | 12 | 16 | 20 |
| THREE OF A KIND | 2 | 4 | 6 | 8 | 10 |
| TWO PAIR | 2 | 4 | 6 | 8 | 10 |
| HIGH PAIR (JACKS OR BETTER) | 1 | 2 | 3 | 4 | 5 |

PAYOFF TABLE 3

For Selections of FOUR DRAW CARDS

| | Number of Coins Bet | | | | |
|---|---|---|---|---|---|
| | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR OF A KIND | 20 | 40 | 60 | 80 | 100 |
| FULL HOUSE | 6 | 12 | 18 | 24 | 30 |
| FLUSH | 4 | 8 | 12 | 16 | 20 |
| STRAIGHT | 4 | 8 | 12 | 16 | 20 |
| THREE OF A KIND | 2 | 4 | 6 | 8 | 10 |
| TWO PAIR | 1 | 2 | 3 | 4 | 5 |
| HIGH PAIR (JACKS OR BETTER) | 1 | 2 | 3 | 4 | 5 |

Figure 2:
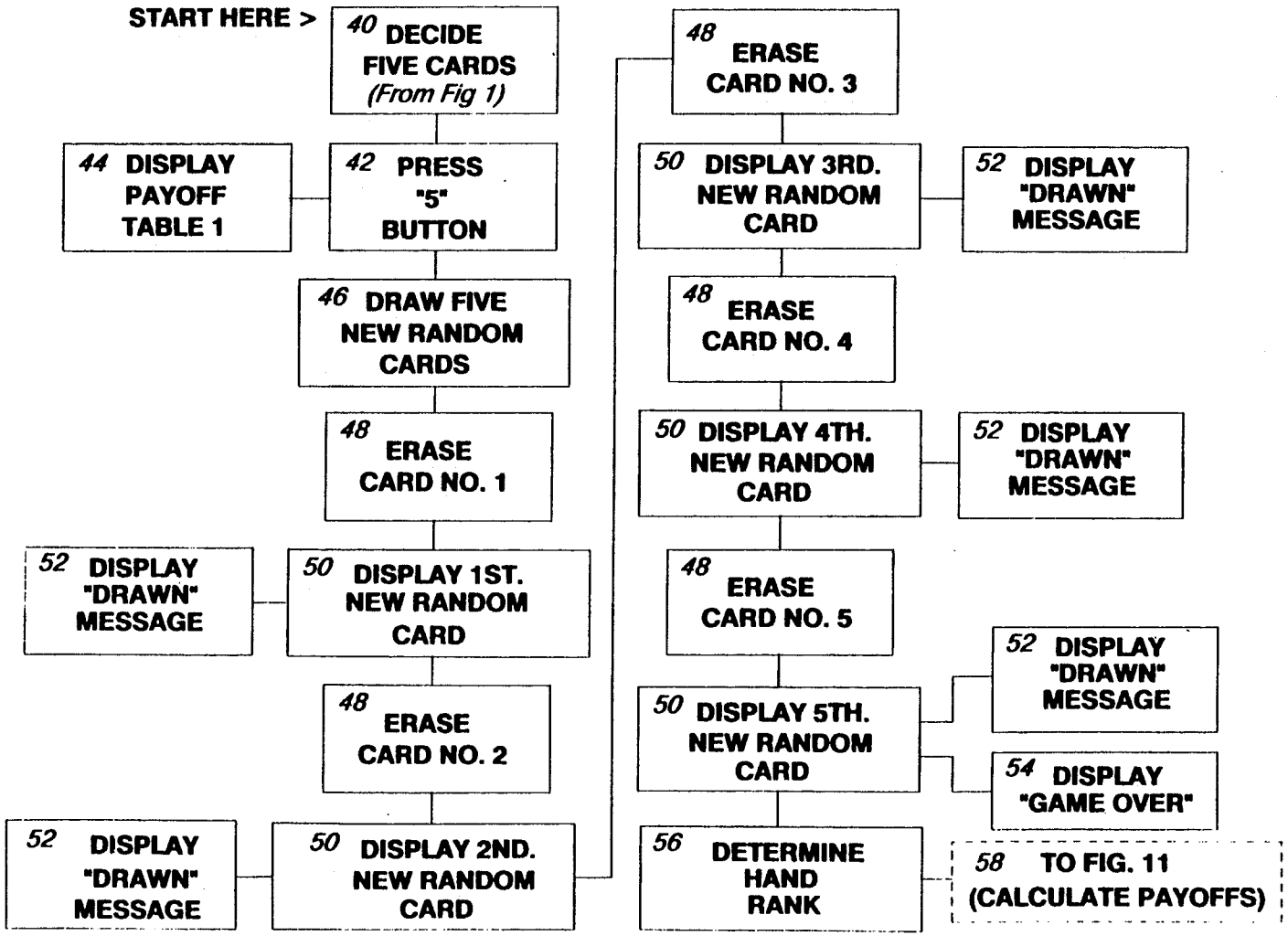
FIG. 2 is a block diagram illustrating the play sequence when the player chooses to draw five cards.

If the player chooses to draw five cards 40, the play sequence takes place according to FIG. 2. The player indicates this choice by pressing the "5" button 42 on the console. The computer then displays payoff Table 1 44 and randomly chooses five new cards 46. The old cards are automatically replaced sequentially by the computer. The computer first erases the originally drawn card 48, displays the new, randomly chosen card 50, and displays the word "DRAWN" under the new card 52. Subsequent cards are replaced in the same manner until the fifth new card is displayed 50 and the "DRAWN" message is displayed underneath it 52. At this point, "GAME OVER" is displayed 54 and the hand rank is determined 56. From this hand rank, the payoff can be calculated 58.

Figure 3:
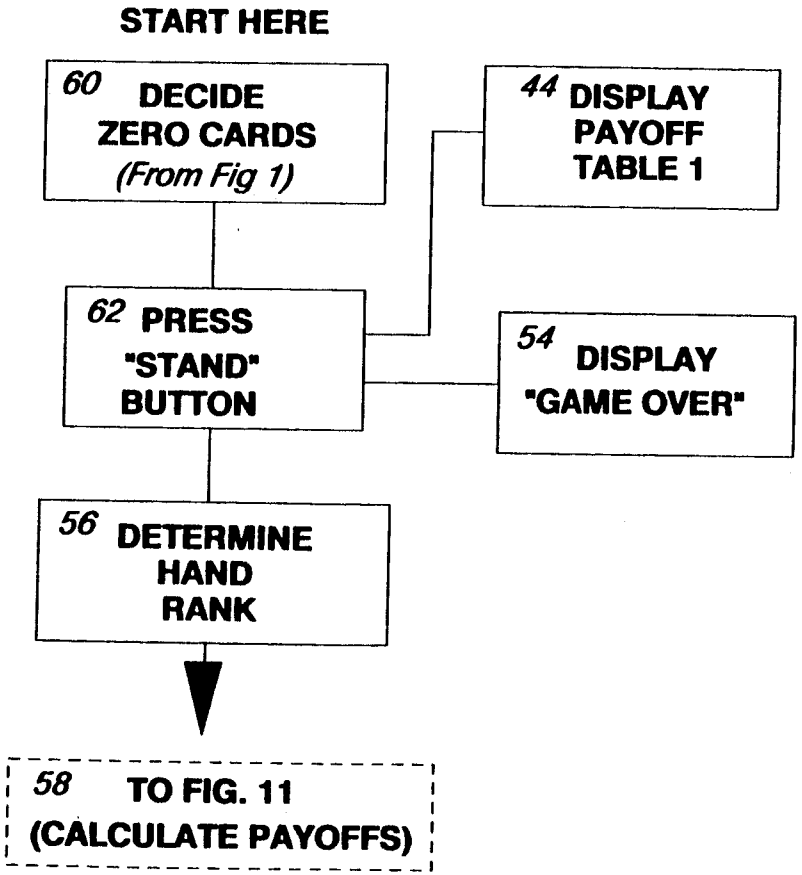
FIG. 3 is a block diagram illustrating the play sequence when the player decides to STAND (i.e. draw zero cards)

FIG. 3 illustrates the play sequence if the player decides not to replace any of the cards 60. When the "STAND" button is pressed 62, the computer automatically displays Payoff Table 1 44 and "GAME OVER" 54 and determines the hand rank from the unchanged original holding 56. From this rank, the payoff can be determined 58.

Figure 4:
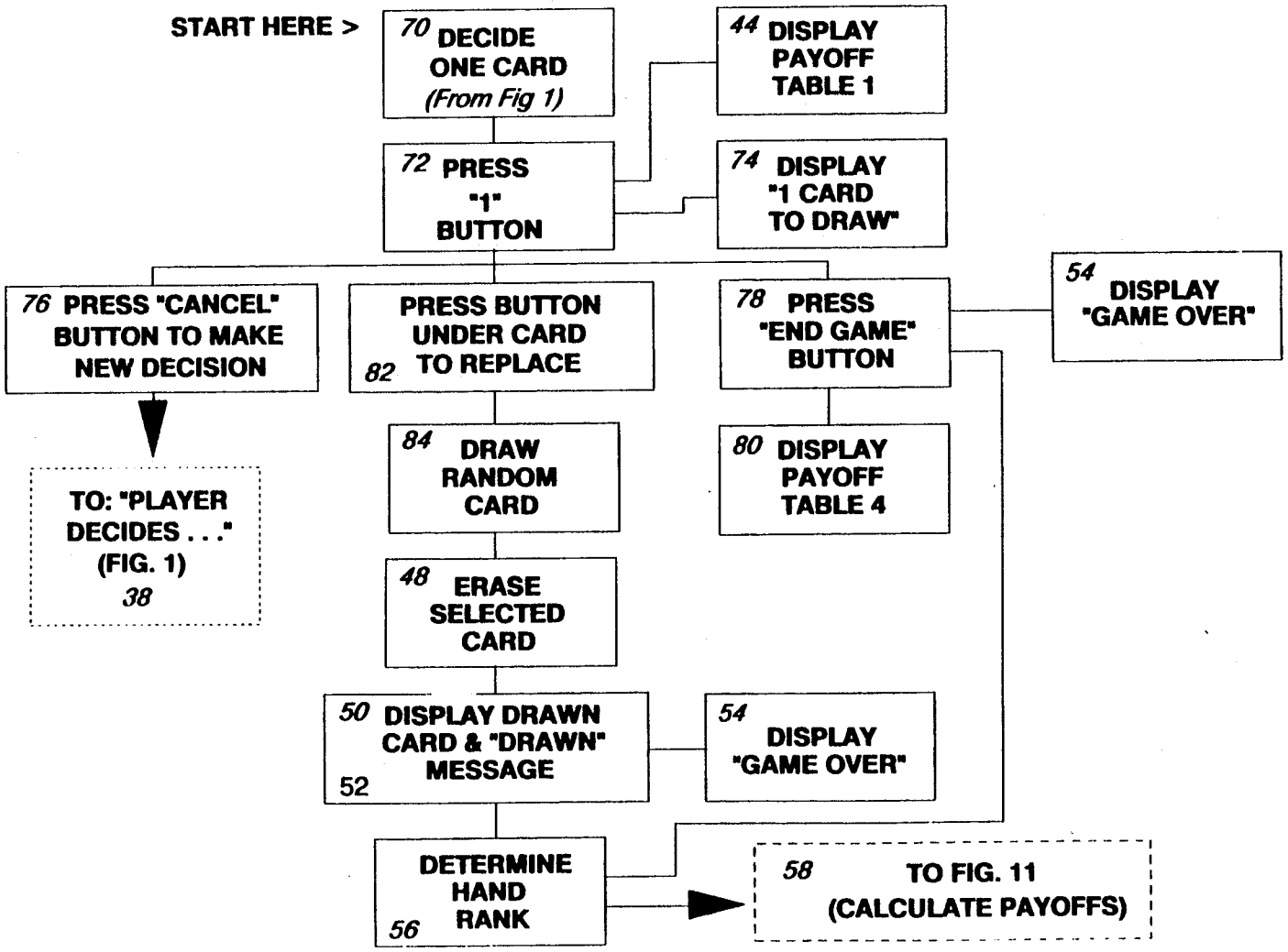
FIG. 4 is a block diagram illustrating the play sequence when the player decides to draw one card.

If the player decides to replace only one card 70 the game progresses according to FIG. 4. When the player presses the "1" button 72, the computer displays Payoff Table 1 44 along with a draw counter indicating that the player has one card to draw 74. The draw counter is decremented each time a new card is drawn.

At this point, the player has three options. If the player decides to change his or her mind about the number of cards to draw, he or she may press the "CANCEL" button to make a new decision 76. This action returns the player to 38.

If the player chooses to end the game at this point, he or she may press the "END GAME" button 78. The player may choose to end the name early because a winning hand may have been achieved by drawing fewer cards than he or she originally anticipated. When confronted with a winning hand that could be reduced in value by drawing additional cards, players can opt to take a reduced payoff rather than risk getting no payoff at all. This early "END GAME" feature with reduced payoffs is not only unique to this invention, but is also necessary for another reason; if payoffs were not reduced with the "END GAME" feature, players would simply elect to always draw the maximum number of cards and then press the "END GAME" button whenever any winning hand is achieved. This would not be profitable for the casino owner and therefore, in the preferred embodiment, the player is paid at a rate equal to one-half of the rate for a winning hand if all of the committed cards had been drawn. Payoff tables reflecting these reduced winnings are shown below:

PAYOFF TABLE 4

For Selections of ONE or TWO DRAW CARDS and also "END GAME" Feature

| | Number of Coins Bet | | | | |
|---|---|---|---|---|---|
| | 1 | 2 | 3 | 4 | 5 |
| ROYAL FLUSH | 125 | 250 | 375 | 500 | 750 |
| STRAIGHT FLUSH | 25 | 50 | 75 | 100 | 125 |
| FOUR OF A KIND | 12 | 25 | 37 | 50 | 62 |
| FULL HOUSE | 4 | 8 | 12 | 16 | 20 |
| FLUSH | 3 | 6 | 9 | 12 | 15 |
| STRAIGHT | 2 | 4 | 6 | 8 | 10 |
| THREE OF A KIND | 1 | 3 | 4 | 6 | 7 |
| TWO PAIR | 1 | 2 | 3 | 4 | 5 |
| HIGH PAIR (JACKS OR BETTER) | 0 | 1 | 1 | 2 | 2 |

PAYOFF TABLE 5

For Selection of THREE DRAW CARDS and also "END GAME" Feature

| | Number of Coins Bet | | | | |
|---|---|---|---|---|---|
| | 1 | 2 | 3 | 4 | 5 |
| ROYAL FLUSH | 125 | 250 | 375 | 500 | 750 |
| STRAIGHT FLUSH | 25 | 50 | 75 | 100 | 120 |
| FOUR OF A KIND | 10 | 20 | 30 | 40 | 50 |
| FULL HOUSE | 3 | 6 | 9 | 12 | 15 |
| FLUSH | 2 | 4 | 6 | 8 | 10 |
| STRAIGHT | 2 | 4 | 6 | 8 | 10 |
| THREE OF A KIND | 1 | 2 | 3 | 4 | 5 |
| TWO PAIR | 1 | 2 | 3 | 4 | 5 |
| HIGH PAIR (JACKS OR BETTER) | 0 | 1 | 1 | 2 | 2 |

PAYOFF TABLE 6

For Selection of FOUR DRAW CARDS and also "END GAME" Feature

| | Number of Coins Bet | | | | |
|---|---|---|---|---|---|
| | 1 | 2 | 3 | 4 | 5 |
| ROYAL FLUSH | 125 | 250 | 375 | 500 | 750 |
| STRAIGHT FLUSH | 25 | 50 | 75 | 100 | 125 |
| FOUR OF A KIND | 10 | 20 | 30 | 40 | 50 |
| FULL HOUSE | 3 | 6 | 9 | 12 | 15 |
| FLUSH | 2 | 4 | 6 | 8 | 10 |
| STRAIGHT | 2 | 4 | 6 | 8 | 10 |
| THREE OF A KIND | 1 | 2 | 3 | 4 | 5 |
| TWO PAIR | 1 | 1 | 1 | 2 | 2 |
| HIGH PAIR (JACKS OR BETTER) | 0 | 1 | 1 | 2 | 2 |

In this case, the computer displays Payoff Table 4 80 and a "GAME OVER" message 54 and goes directly to determining the hand rank 56 and calculating the appropriate payoff 58.

If the player decides to stay with his or her initial commitment to draw one card, he or she chooses the draw card to replace and presses the button corresponding to that card 82. The computer then randomly chooses a card 84, erases the card selected by the player 48 and displays the drawn card 50 and the "DRAWN" message underneath it 52 as well as the "GAME OVER" message 54. The hand rank is then determined 56 and an appropriate payoff is calculated 58.

Figure 5:
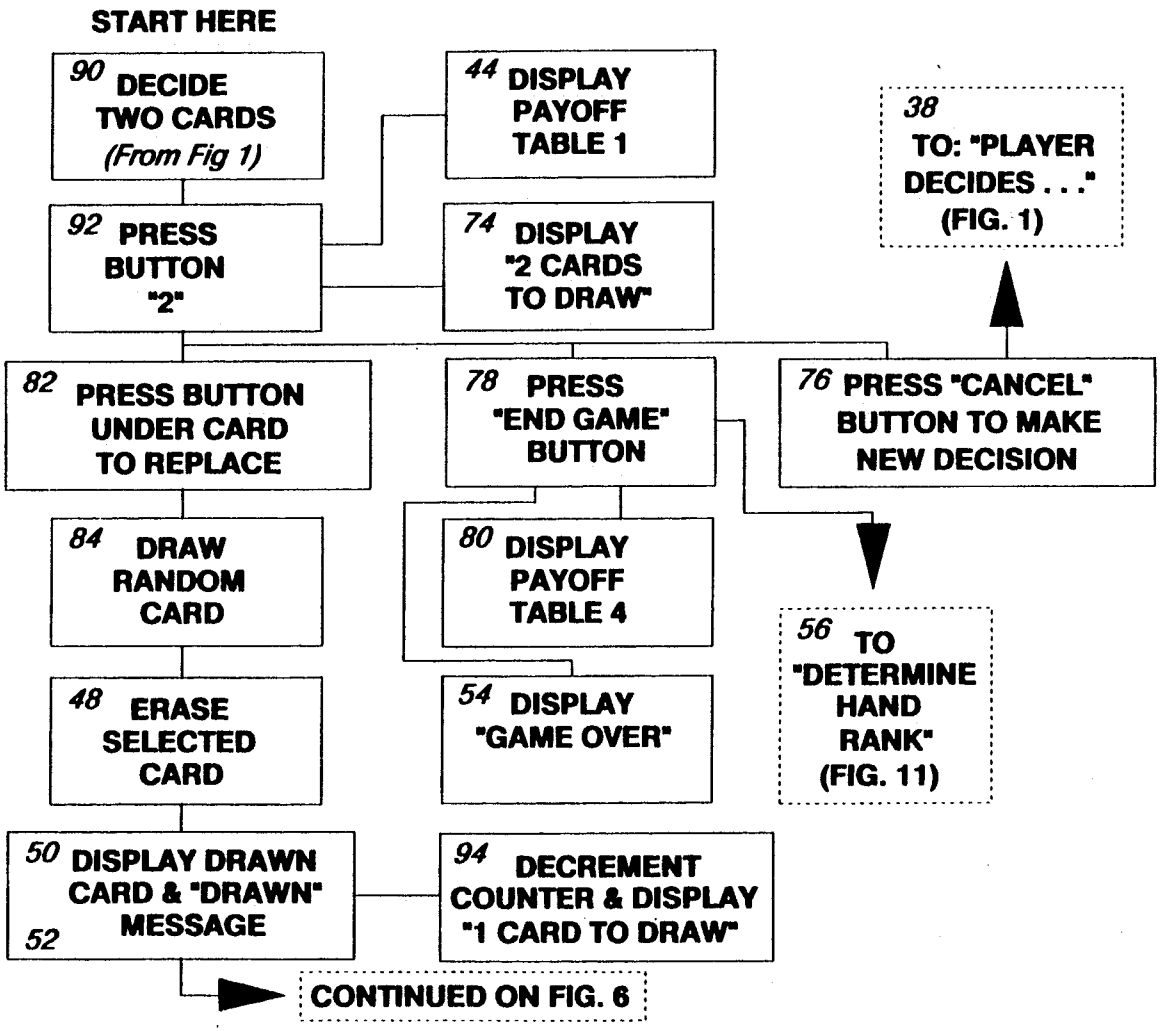
FIG. 5 and FIG. 6 are block diagrams illustrating the play sequence when the player decides to draw two cards.
Figure 6:
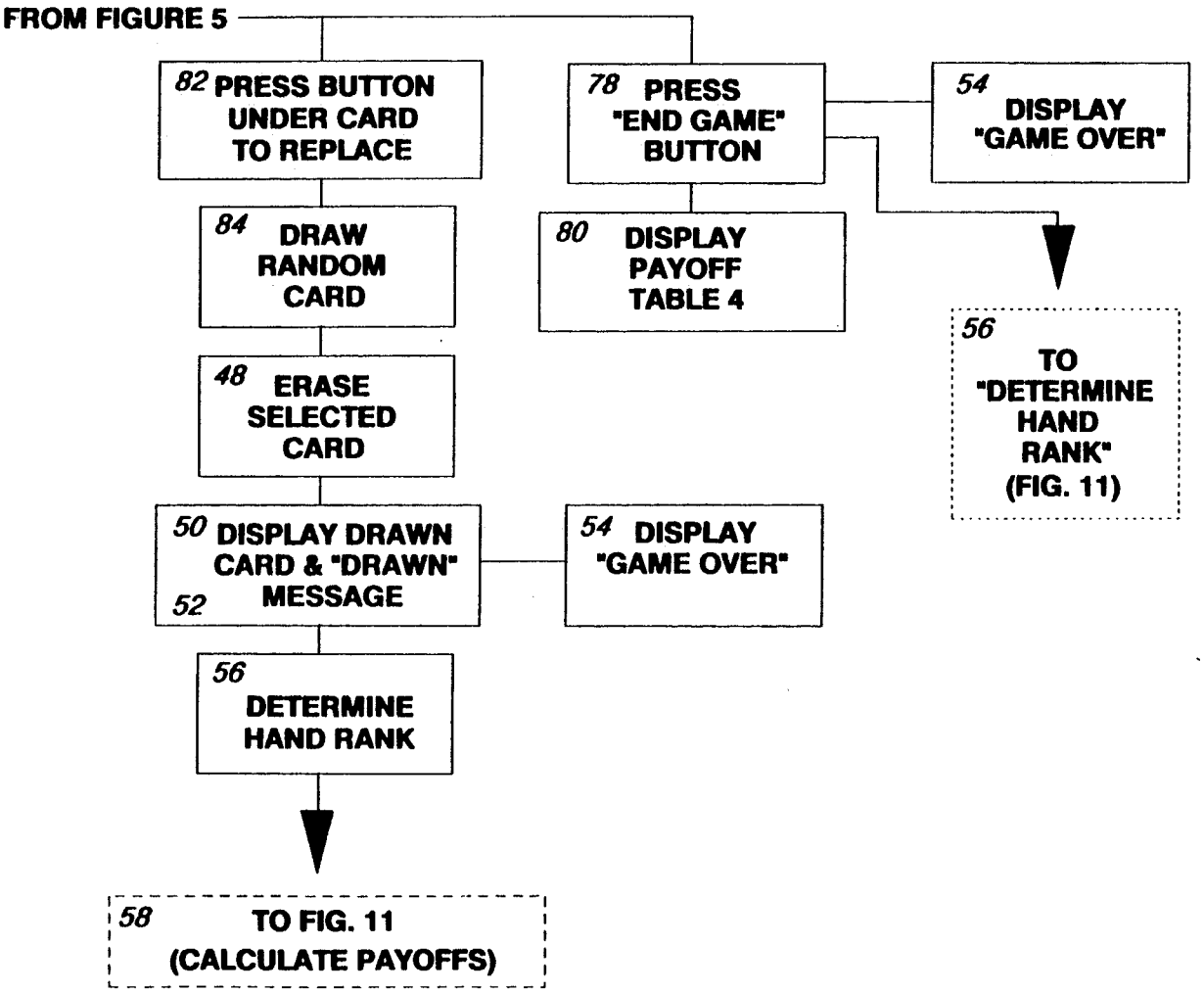

Referring to FIG. 5 and FIG. 6, the player in this case decides to draw two cards 90 and indicates this choice by pressing the "2" button 92 which then prompts the computer to display Payoff Table 1 44 and the draw counter indicating the number of draw cards remaining 74. At this point, the player has three choices. The player may choose to cancel his or her initial choice as to the number of draw cards by pressing "CANCEL" 76, which takes the player back to 38. If the player chooses to press the "END GAME" button 78, Payoff Table 4 is displayed 80 along with the "GAME OVER" message 54, and the hand rank is automatically determined 56 along with the appropriate payoff 58.

If the player decides to replace a card, he or she presses the button which corresponds with the card to be replaced 82. The computer then randomly draws a new card 84 erases the card selected by the player 48 and displays the new card 50 along with a "DRAWN" message 52. The computer then decrements the draw counter and displays the number of draw cards remaining 94, in this case, one card.

The player may now choose to either end the game or to replace another card. In this particular case, if the "END GAME" button is pressed 78, Payoff Table 4 is displayed 80 with the "GAME OVER" message 54 and hand rank is determined 56 along with the appropriate payoff 58.

If the player chooses to replace the remaining card, he or she presses the button corresponding to the selected card 82, which then prompts the computer to draw another random card 84, erase the selected card 48, and display the newly drawn card 50 and a "DRAWN" message underneath it 52. At this point, the computer also displays the "GAME OVER" message 54 and determines the hand rank 56 and the corresponding payoff 58.

Figure 7:
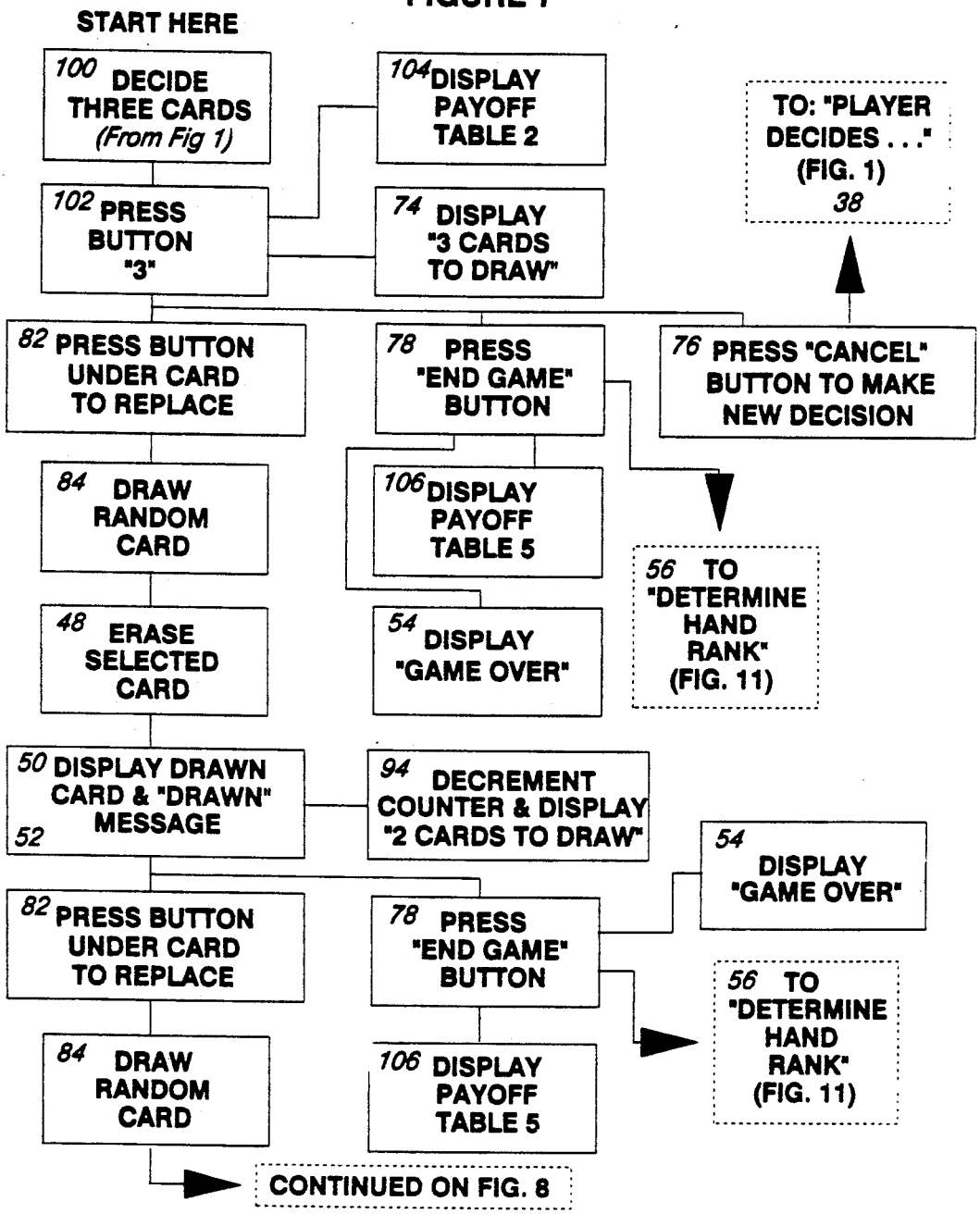
FIGS. 7 and 8 are block diagrams illustrating the play sequence when the player decides to draw three cards.
Figure 8:
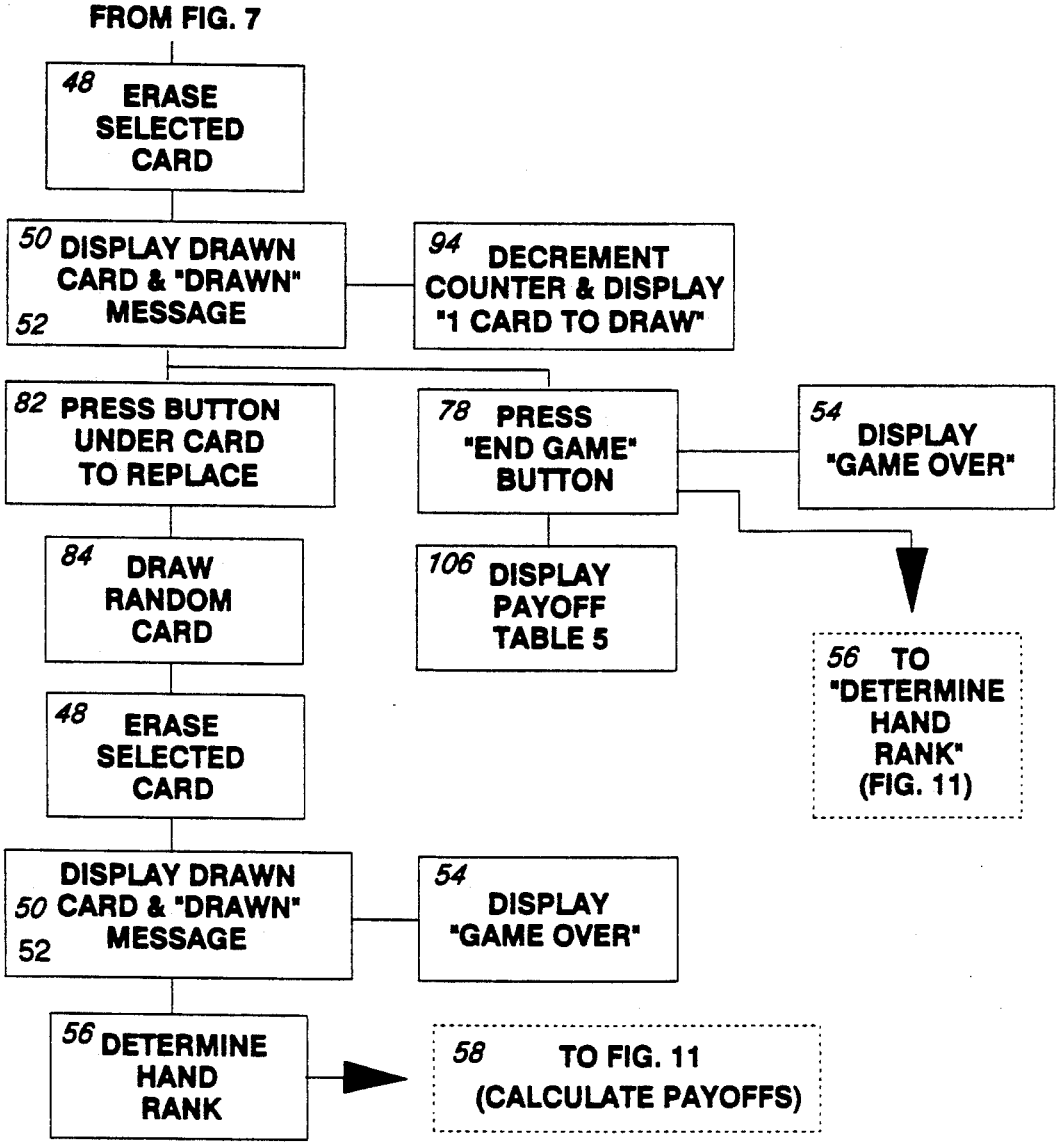

FIGS. 7 and 8 show the play sequence if the player decides to draw three cards 100. The progression of the game is quite similar to the sequence just described. The player indicates his or her choice by pressing the appropriate button 102, which in turn prompts the computer to display Payoff Table 2 104, and the draw counter indicating the number of cards the player has chosen to draw 74. As before, the player may press the "CANCEL" button to make a new decision on the number of cards to draw 76 and return game play to 38. As before, the player may also choose to press "END GAME" 78, which prompts the computer to display Payoff Table 5 106 and the "GAME OVER" message 78 as well as to determine hand rank 56 and the appropriate payoff 58.

If the player chooses to replace one or more cards, he or she can do this one card at a time and examine the hand after each individual card is drawn. As always, replacement is accomplished by pressing a DRAW button which is positioned under each card 82. The computer then randomly chooses a card 84 and erases the card selected by the player 48. The new card is then displayed 50 along with the "DRAWN" message 52. The computer then decrements the draw counter and displays the number in the counter as the number of cards left to draw 94. If, at this point, the player has a winning hand and does not wish to draw anymore cards, he or she may choose to press the "END GAME" button 78, which in turn causes the computer to display Payoff Table 5 106 and the "GAME OVER" message 54. Hand rank 56 and payoff 58 is determined at this point. If the player chooses to continue drawing and replacing cards, he or she may press a button corresponding to the next card to replace 82. Each time a card is selected by the player and replaced by the computer, the draw counter is decremented and the player has a choice to either end the game or replace another card until the number of committed cards is replaced and the draw counter thereby equals zero. As before, the "GAME OVER" message is displayed 54 and the hand rank is determined 56 when the draw counter reaches zero or the "END GAME" button is pressed 78.

Figure 9:
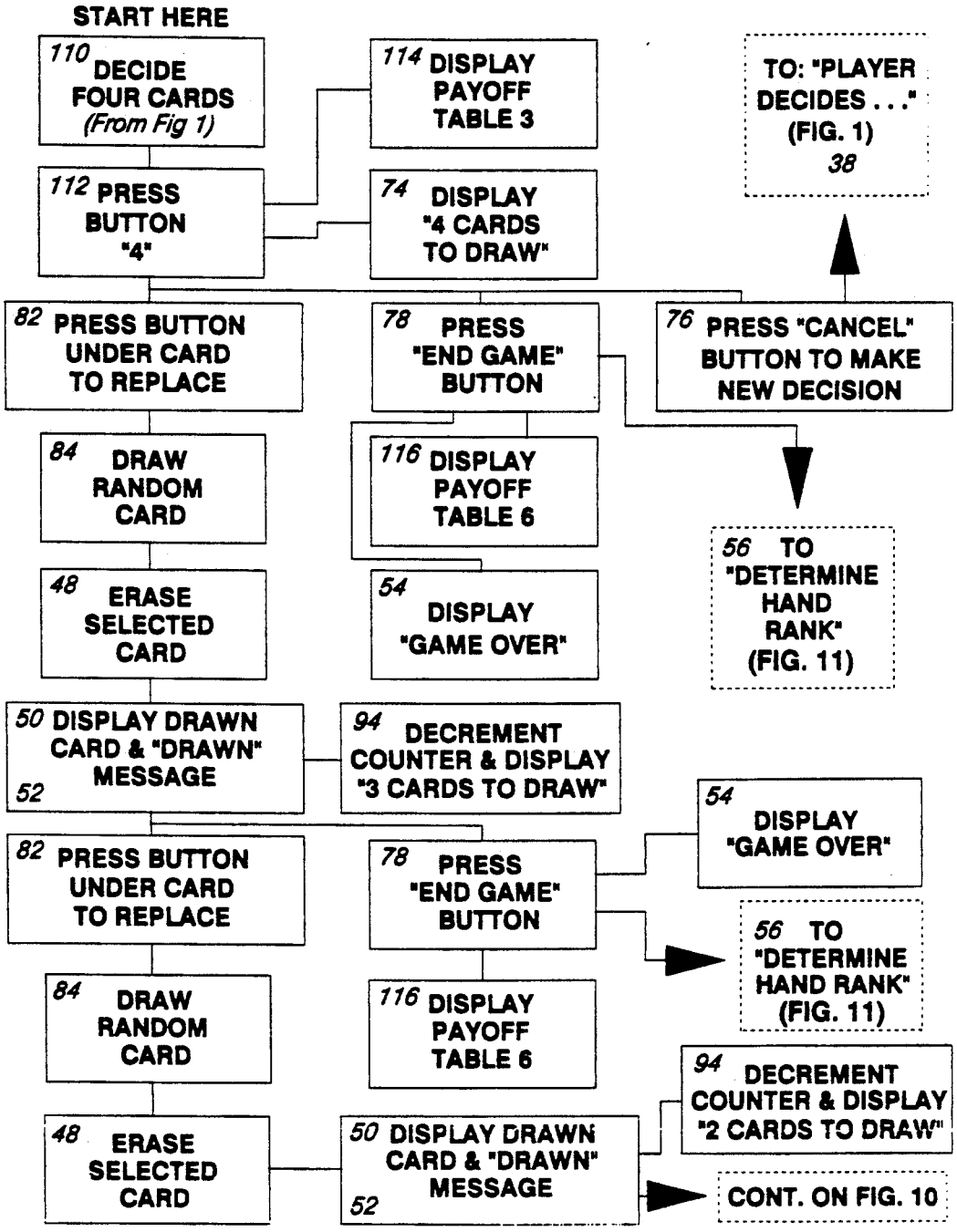
FIGS. 9 and 10 are block diagrams illustrating the play sequence when the player decides to draw four cards.
Figure 10:
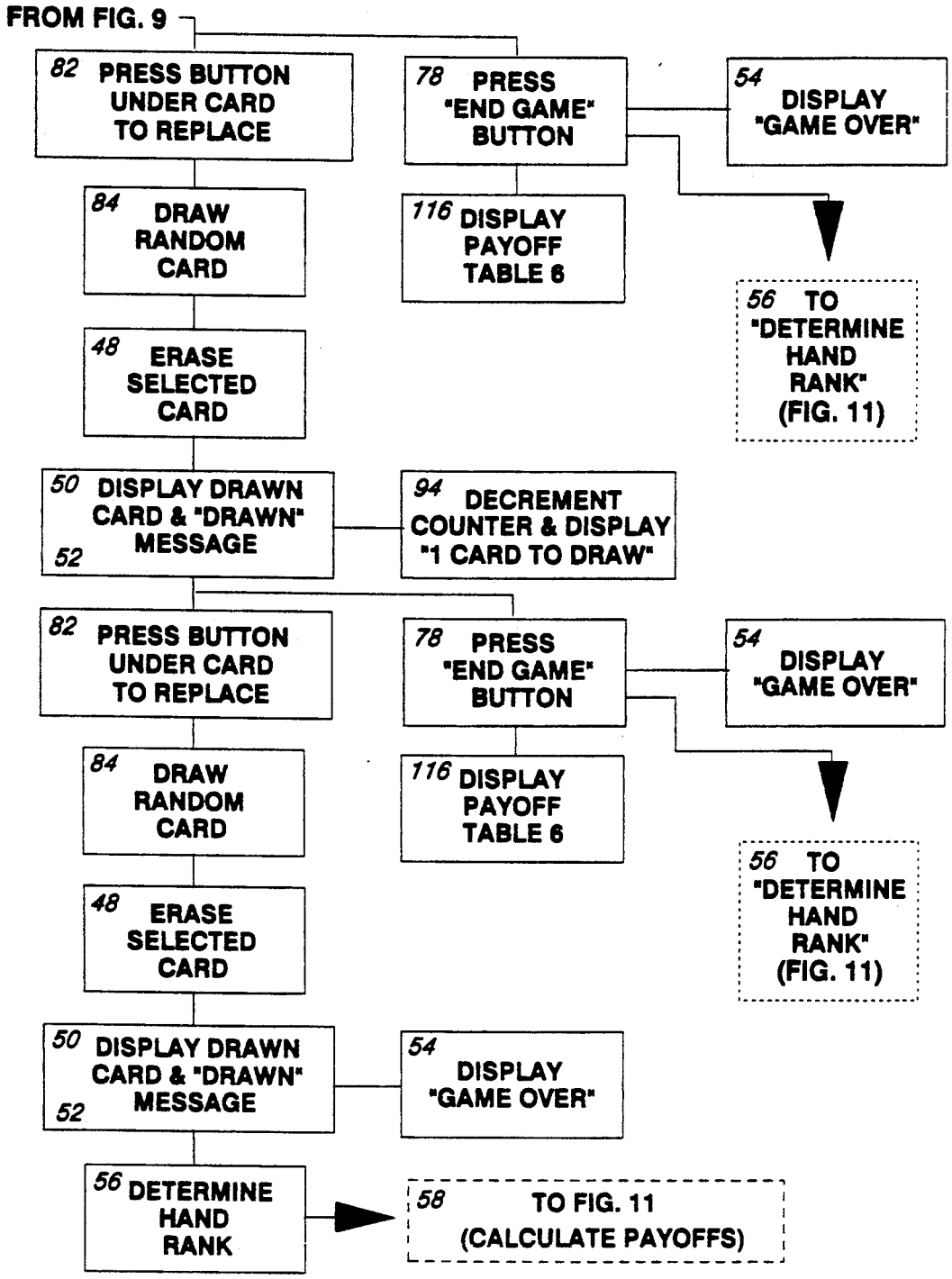

FIGS. 9 and 10 show the play sequence when the player chooses to draw four cards 110. The player indicates his or her choice by pressing button "4" 112 which signals the computer to display Payoff Table 3 114 and the draw counter indicating the number of draw cards remaining 74. Like the previous play sequences, the player can either press "CANCEL" to choose a different number of cards to draw 76 and go back to 38, press "END GAME" to display Payoff Table 6 116 and the "GAME OVER" message 54 and to determine the hand rank 56 and corresponding payoff 58 or choose a card to replace 82. Replacing a card takes place in the usual manner. The player presses the button under the card he or she wishes to replace 82, letting the computer randomly choose a card 84, erase the card selected by the player 48, display the new card 50 and the "DRAWN" message 52 and decrement the draw counter 94. After replacing at least one card, the player can either choose to press the "END GAME" button 78, which signals the computer to display Payoff Table 6 116 and the "GAME OVER" message 54 and also to determine the hand rank 56 and the corresponding payoff 58. The player may also choose to replace another card 82, and therefore re-initiate the draw-erase-display-decrement cycle. After each draw card replacement cycle, the player can either choose to end the game or replace another card until the counter reaches zero.

Figure 11:
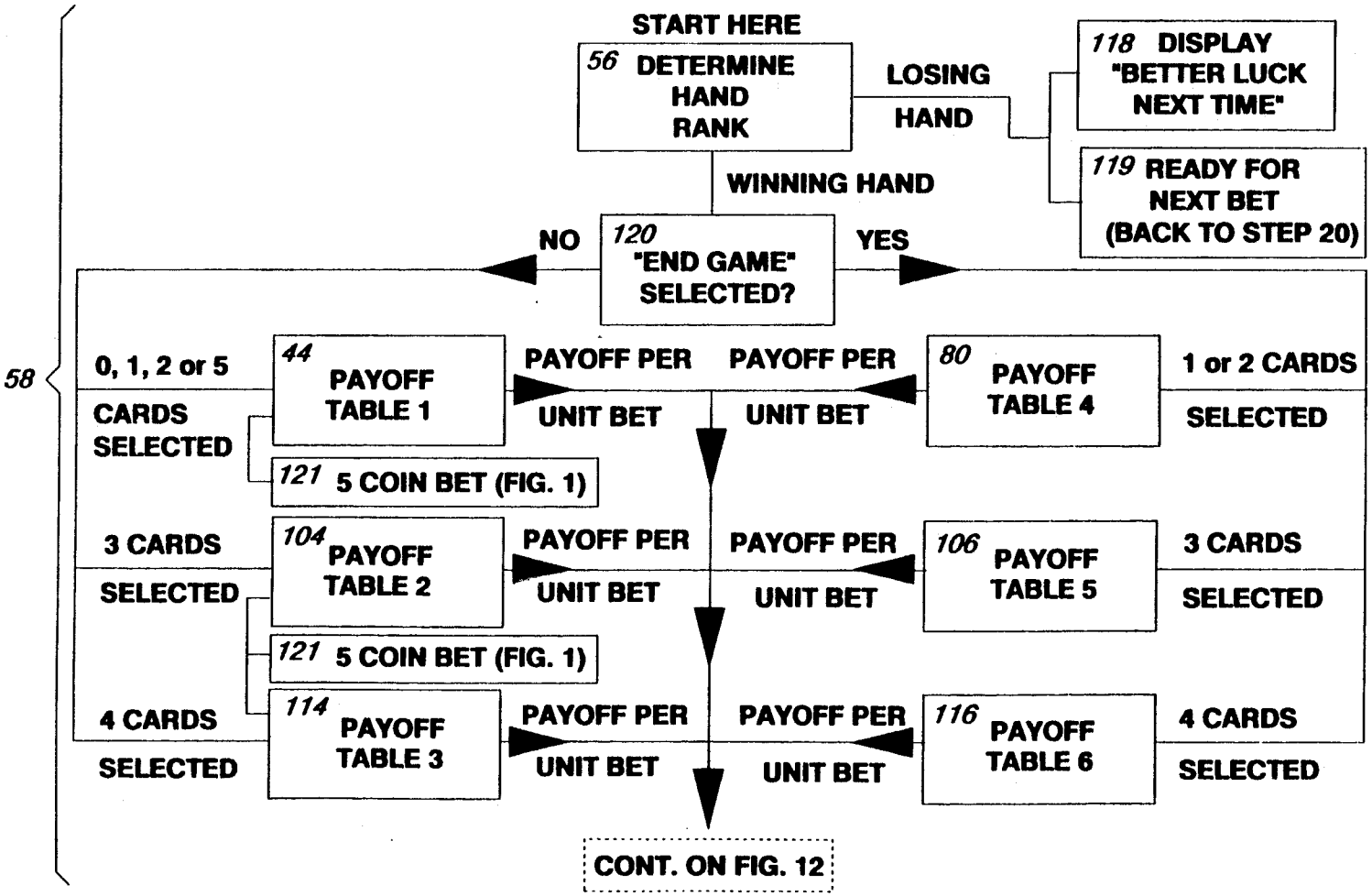
FIGS. 11 and 12 are block diagrams illustrating the sequence at the final stages of any hand, including evaluation of the final five card holding and determination of the appropriate payoff.
Figure 12:
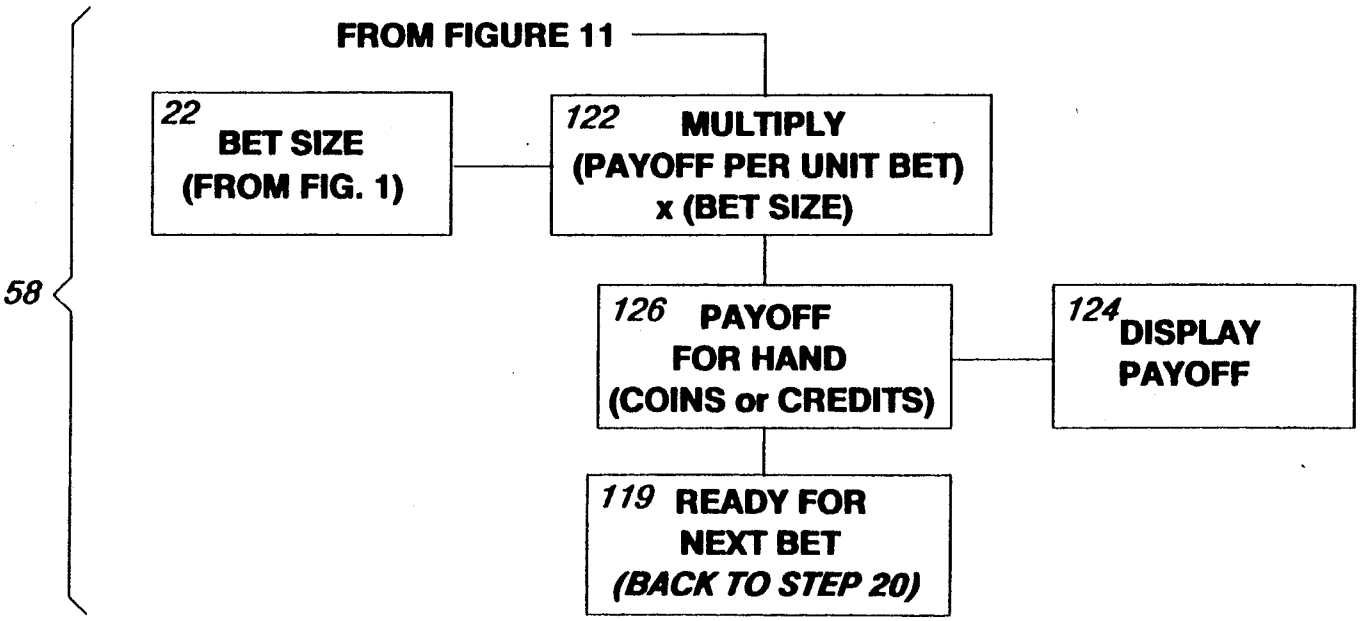

Referring now to FIGS. 11 and 12, the computer evaluates hand rank 56 and corresponding payoff 58 after all of the committed cards have been replaced for the particular hand or the "END GAME" button is pushed. The computer first evaluates whether the final five card holding is a losing hand or a winning hand. If the final five card holding is a losing hand, the computer displays a consolation message 118 and returns 119 to take the next bet 20.

If the final holding is a winning hand, the computer then checks to see if the "END GAME" option had been selected 120. If the option had not been selected, then the payoff table is determined by the number of draw cards that the player had selected. If 0, 1, 2 or 5 cards had been selected, then Payoff Table 1 44 is used to determine the payoff per unit bet. Payoff Table 2 is used if three cards were selected 104, and Payoff Table 3 is used if four cards were selected 114. The computer also checks if five coins were bet 121 to determine whether certain bonus payoff rates should be awarded.

If the "END GAME" option was selected 78, then a different set of tables with reduced payoffs is used to determine the payoff per unit bet. Payoff Table 4 is used if one or two cards were selected 80, Payoff Table 5 is used if three cards were selected 106, and Payoff Table 6 is used if four cards were selected 116. Regardless of the table used to determine the payoff per unit bet, the computer assigns a rank value corresponding with the rank of the hand and multiplies this number by the bet size recorded 22 to determine the final payoff 122. This payoff is displayed on the screen 124 and disbursed to the player in the form of coins or play credits 126. The machine then resets itself 119 to return to 20 and take the next bet.

Figure 13:
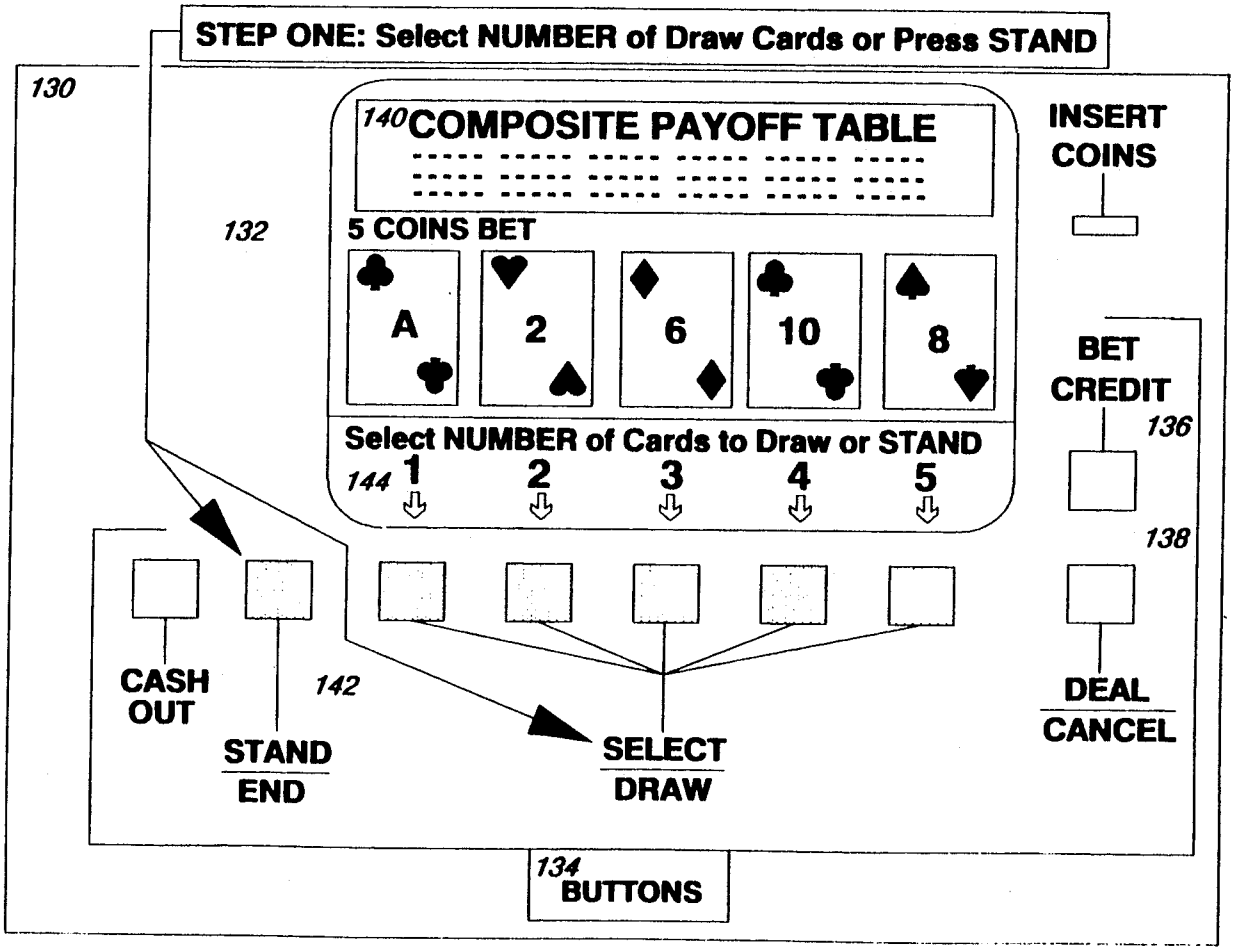
FIG. 13 illustrates a console and display of a video poker game machine according to the present invention after receiving a bet from a player.

To further clarify the present invention, FIG. 13 shows a console and display of the video poker machine according to the present invention 130. The console itself has a screen 132 and an arrangement of buttons 134 that the player would use to play the game. Buttons 134 available for player use at a particular point in the game are shaded in the figures. In practice, it is customary to illuminate these buttons or even to have the illumination flashing. This particular figure shows the console after the player has made a 5 coin bet by inserting coins or using the BET CREDIT button 136. The DEAL button 138 has been pushed and the first five cards are now displayed for the player's inspection. At this point, the composite payoff table 140 is displayed on the screen. The player may now either select a number of draw cards or press the STAND button 142. A message 144 and arrows at the bottom of the video screen instruct the player to select a number of draw cards or press STAND. In the preferred embodiment, the STAND button 142 may be used as a dual function button to either allow the player to STAND or END GAME. Additionally, the DEAL button 138 can also be used as a CANCEL button. Since these functions will not be used at the same point in any game, the dual function is practical.

Figure 14:
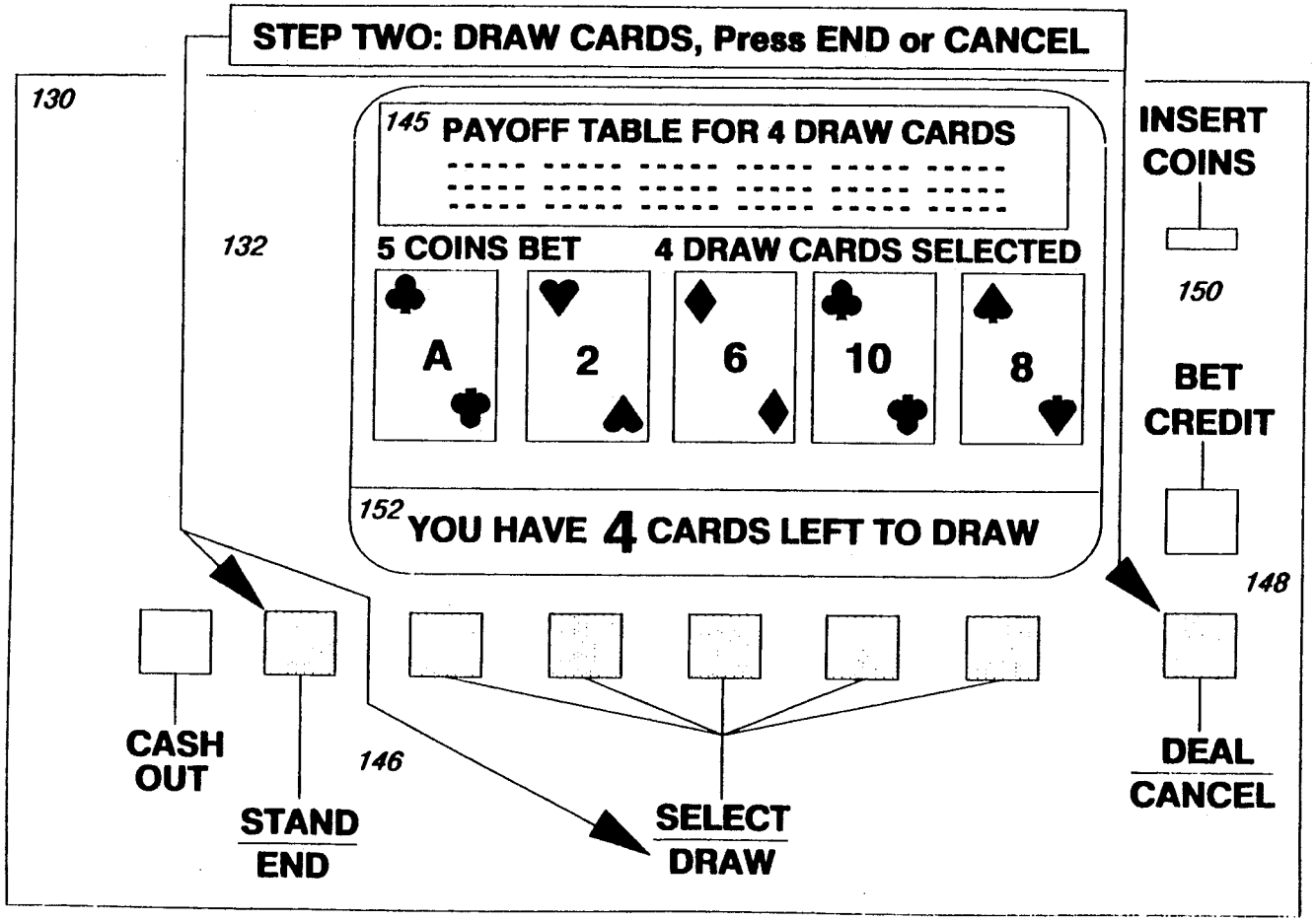
FIG. 14 illustrates the console and display of the present invention after the player has committed to a particular number of draw cards.

FIG. 14 shows the screen and console 130 after the player has decided to draw four cards. The payoff table 145 for four cards is now displayed on the screen 132. The player may now choose to draw cards, press the END GAME button 146 to end the game, or press the CANCEL button 148 to choose a different number of draw cards. Since the player has not yet actually replaced any cards, he or she can still CANCEL the decision to draw four cards. The screen 132 now shows the number of cards selected 150 and a draw counter 152.

Figure 15:
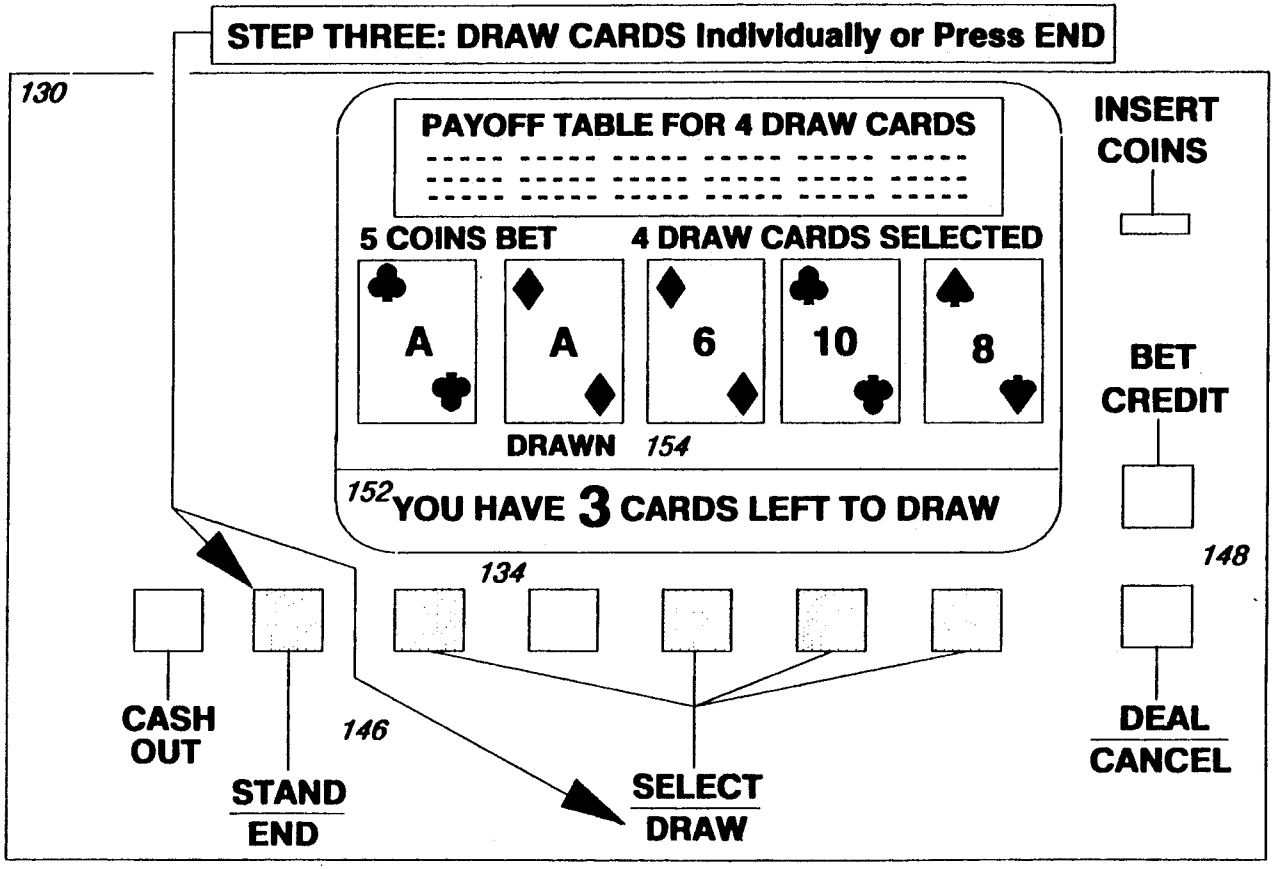
FIG. 15 illustrates the console and display of the present invention after the player has drawn one card.

FIG. 15 shows the screen and console 130 after the player has drawn the first card. The information in the draw counter 152 has been updated to let the player know that he or she now has three cards left to draw. The CANCEL feature 148 is no longer available since the card has already been drawn. Also a "DRAWN" message 154 under the new card and the absence of illumination from the button 134 under the drawn card indicates to the player that this card is not available to replace during subsequent selections. This procedure is repeated until no more cards are left to draw (i.e. the draw counter 152 equals zero), or the player pressed the END button 146. Either of these would end the game and result in an evaluation of the displayed five card holding with an appropriate payoff.

The following tables compare the "expected player return" between the basic game of video poker and the video poker game which is our preferred embodiment.

TABLE 18

EXPECTED PLAYER RETURN FOR "9-6" BASIC VIDEO POKER MACHINE

| Hand | Frequency of Occurrence (%) | Payoff Per Unit Bet | Contribution To Expected Return |
|---|---|---|---|
| Royal Flush | 0.00255 | 800(*) | 2.040 |
| Straight Flush | 0.01115 | 50 | 0.558 |
| Four Of A Kind | 0.23582 | 25 | 5.896 |
| Full House | 1.14860 | 9 | 10.337 |
| Flush | 1.15174 | 6 | 6.910 |
| Straight | 1.27175 | 4 | 5.087 |
| Three Of A Kind | 7.41034 | 3 | 22.231 |
| Two Pair | 12.84670 | 2 | 25.693 |
| High Pair | 21.08390 | 1 | 21.084 |
| None Of Above | 54.83205 | 0 | 0.000 |
| TOTALS | 100.00000% | | 99.836% |

(*)Assumes Five Coins Are Bet

TABLE 19

EXPECTED PLAYER RETURN FOR VIDEO POKER WITH MULTIPLE PLAYER CHOICES

| Hand | Frequency of Occurrence (%) | Effective Payoff Per Unit Bet | Contribution To Expected Return |
|---|---|---|---|
| Royal Flush | 0.00255(#) | 800.00(*) | 2.04% |
| Straight Flush | 0.01115(#) | 50.00 | 0.56% |
| Four Of A Kind | 0.29 | 22.40 | 6.50% |
| Full House | 1.55 | 6.78 | 10.51% |
| Flush | 1.05 | 5.44 | 5.71% |
| Straight | 1.28 | 4.00 | 5.12% |
| Three Of A Kind | 8.09 | 2.20 | 17.80% |
| Two Pair | 15.08 | 1.77 | 26.69% |
| High Pair | 23.22 | 1.00 | 23.22% |
| None Of Above | 49.44 | 0.00 | 0.00% |
| TOTALS | 100.00% | | 98.15% |

(#)Same Percentages As Basic Video Poker
(*)Assumes Five Coins Are Bet

The mathematical analysis for the basic video poker game in Table 18 was computed by the Seattle Gaming Institute and published in their book "A Guide To Video Poker" in 1982. The analysis for the present invention in Table 19 is based on the actual play of 10,000 hands of the new game using an optimized playing strategy developed by the developers. Since 10,000 hands did not yield a statistically significant number of royal flush and straight flush winning hands, these "frequency of occurrence" percentage values were copied from the values found for the basic video poker game. This was felt to be fairly accurate since these hands are very rare and their play is fairly standard.

Of particular interest in Tables 18 and 19 is that the expected player returns are virtually identical for both the basic video poker game and the present invention. This was achieved by tailoring the payoff tables of the invention as described herein. The equal expected player returns assures playing satisfaction for the player and profitability for the casino owner.

The invention has been described in conjunction with a specific embodiment; however, there are many alternatives, modifications and variations which will be apparent to those skilled in the art in light of the foregoing description. Accordingly, the invention is intended to embrace all such alternatives, modifications, and variations that fall within the scope of the following claims.

What is claimed is:

1. A method of playing a video poker game using a computer and a video screen comprising the steps of:

(a) receiving a bet value from a player;
(b) selecting and displaying a plurality of cards on the video screen;
(c) receiving at least one signal from the player, each signal corresponding to an election to select a draw card made by the player;
(d) storing the total number of draw cards as a draw value;
(e) generating a final poker hand by replacing the draw cards selected by the player;
(f) determining a rank of the final poker hand;
(g) assigning a rank value to the rank of the final poker hand;
(h) selecting a payoff table from a plurality of payoff tables based on the draw value; and
(i) calculating a payoff using the rank value and the bet value as indices in the selected payoff table.

2. The method of claim 1 wherein step (i) comprises the steps of:

(i) determining a payoff per unit bet using the rank value and the bet value as indices in the selected payoff table; and
(ii) calculating a total payoff by multiplying the payoff per unit bet and the bet value.

3. A method of playing a video poker game using a computer and video screen comprising the steps of:

(a) receiving a bet value from a player;
(b) selecting and displaying a plurality of cards on the video screen;
(c) receiving a draw value from the player;
(d) storing the draw value as a draw counter;
(e) receiving a signal from the player;
(f) determining if the signal identifies a draw card;
(g) erasing the draw card from the video screen if the signal is a draw card signal;
(h) selecting a replacement card;
(i) displaying the replacement card on the video screen;
(j) decrementing the draw counter;
(k) checking the draw counter to determine if it is greater than zero;
(l) repeating steps (e) through (k) if the draw counter is greater than zero;
(m) evaluating the plurality of displayed cards in accordance with a set of poker rules;
(n) assigning a rank value to the plurality of cards; and
(o) determining a player payoff value from the rank value and the bet value.

4. The method of claim 3 wherein step (o) comprises the steps of:

(i) selecting a payoff table from a plurality of payoff tables;
(ii) calculating a payoff per unit bet using the rank value and the bet value as indices in the selected payoff table; and
(iii) calculating a total payoff by multiplying the payoff per unit bet and the bet value.

5. The method of claim 4 wherein the selection of a payoff table from the plurality of payoff tables is based on the draw value.

6. The method of claim 3 wherein step (f) further comprises the steps of:

(i) determining if the signal is an END GAME signal;
(ii) proceeding to (m) if the signal is an END GAME signal; and (iii) reducing the player payoff value if the signal is an END GAME signal.

7. The method of claim 6 wherein step (o) further comprises the steps of:

(i) selecting a payoff table from a plurality of payoff tables;

(ii) calculating a payoff per unit bet using the rank value and the bet value as indices in the selected payoff table; and (iii) calculating a total payoff by multiplying the payoff per unit bet and the bet value.

8. A method of playing a video poker game using a computer and video screen comprising the steps of:

(a) receiving a bet value from a player;

(b) selecting and displaying a plurality of cards on the video screen;

(c) receiving a draw value from the player;

(d) storing the draw value as a draw counter;

(e) receiving a signal from the player;

(f) determining if the signal is an END GAME signal;

(g) proceeding to (o) if the signal is an END GAME signal;

(h) determining if the signal identifies a draw card;

(i) erasing the draw card from the video screen;

(j) selecting a replacement card;

(k) displaying the replacement card on the video screen;

(l) decrementing the draw counter;

(m) checking the draw counter to determine if it is greater than zero;

(n) repeating steps (e) through (m) if the draw counter is greater than zero;

(o) evaluating the plurality of displayed cards in accordance with a set of poker rules;

(p) assigning a rank value to the plurality of cards;

(q) selecting a payoff table from a plurality of payoff tables;

(r) calculating a payoff per unit bet using the rank value and the bet value as indices in the selected payoff table;

(s) calculating a total payoff by multiplying the payoff per unit bet and the bet value; and (t) reducing the player payoff value if the signal is an end game signal.

9. The method of claim 8 wherein the selection of a payoff table from the plurality of payoff tables is based on the draw value.

10. The method of claim 8 wherein the selection of a payoff table from the plurality of payoff tables is based on the draw value if the draw counter equals zero and the selection of a payoff table from a different plurality of payoff tables is based on the draw counter if the signal is an end game signal.

* * * * *